United States Patent [19]

Nicolai et al.

[11] 4,251,028

[45] Feb. 17, 1981

[54] ENERGY RECOVERY SYSTEM FOR BOILER AND DOMESTIC WATER

[75] Inventors: Richard Nicolai, 2226 First Ave., Ronkonkoma, N.Y. 11779; Kenneth Schlaepfer, Farmingville, N.Y.

[73] Assignee: Richard Nicolai, Ronkonkoma, N.Y.

[21] Appl. No.: 945,682

[22] Filed: Sep. 25, 1978

[51] Int. Cl.[3] ..... F24D 3/00; F22B 33/00

[52] U.S. Cl. ..... 237/8 R; 122/20 B; 165/DIG. 2

[58] Field of Search ..... 237/8 R, 55, 8 A; 122/20 B; 165/DIG. 2

[56] References Cited

U.S. PATENT DOCUMENTS

| | | | |
|---|---|---|---|
| 871,706 | 11/1907 | Kline et al. | 122/20 B |
| 2,026,399 | 12/1935 | Pierce | 122/20 B |
| 2,307,600 | 1/1943 | Munters et al. | 237/55 |
| 3,896,992 | 7/1975 | Borovina et al. | 237/19 |

*Primary Examiner*—William E. Wayner
*Assistant Examiner*—Harry Tanner
*Attorney, Agent, or Firm*—Lackenbach, Lilling & Siegel

[57] ABSTRACT

A preheater unit which includes a chamber for boiler water and a domestic water heating coil is arranged in heat exchange relationship with the exhaust duct of a boiler of a heating system for extracting heat from the flue gases. Boiler water may be shut off to the heat radiating system in the summer although boiler water is fed to the preheater unit both in summer and in winter. The domestic water heating coil within the preheater unit is connected in series flow relationship with the domestic water heating coil interiorly of the boiler. A summer/winter switch is added to the conventional boiler circuitry to enable control of the water circulator by the thermostat in the winter, while the water circulator is operated by the upper limit aquastat during summer operation whenever the burner of the boiler is energized.

13 Claims, 3 Drawing Figures

ENERGY RECOVERY SYSTEM FOR BOILER AND DOMESTIC WATER

BACKGROUND OF THE INVENTION

The present invention relates to heating systems, and more specifically to a heat recovery system for boiler and domestic water.

Conventionally, the cold water supply line is fed to a boiler tankless coil where the cold domestic water is heated by the boiler water and released to be used in hot water fixtures of a house. The boiler water, on the other hand, when returned from the house heating units or house radiating system, returns to the boiler through a water circulator. After being reheated, the boiler water is forced back into the house heating units.

A major disadvantage of the conventional arrangement is that feeding cold water to the boiler tankless coil reduces the efficiency of the boiler since the boiler must heat the cold water from approximately 40°-50° F. to approximately 120°-180° F. Although requiring a great input of heat for this purpose, a great deal of the boiler heat escapes through the stack with the flue gases without the heat being retrieved.

In addition to reducing the efficiency of the boiler for heating the boiler water, prior art systems which only utilized an internal boiler tankless coil were also deficient in providing sufficient quantities of domestic water for bathing, using major appliance, etc. It frequently occurs that the capacity of the boiler tankless coil is insufficient for producing sufficient quantities of domestic hot water or heating such water sufficiently rapidly to provide the desired quantities.

In U.S. Pat. No. 2,189,749, which discloses a water heater, suggests the use of a supplemental heating unit using flue gases passing through an envelope filled with boiler water through which a coil for domestic water passes. However, the arrangement described requires that the flue gases be forced from the heating boiler down into and through the supplemental heating unit. Such an arrangement is not recommended for many reasons. Firstly, it causes back pressure on the system as heated gases rise to be vented. Also, the excess pressure can cause relief-type devices to blow off which can soot up an entire dwelling. Further, with the arrangement in the patent, using a tube and baffle design, soot will collect if the oil burner is not running to peak performance. Additionally, the disclosed device utilizes a damper operated by an actuating rod, and the damper could carbonize and that sends heat causing the butterfly to malfunction. This could also cause back pressure which may result in a release of soot in the premises.

U.S. Pat. No. 2,554,338 is for a water heater and uses an auxiliary water heating tank inside the furnace with a pipe coaxial with the flue leading to a tank surrounding the flue. However, the two auxiliary hot water tanks which are disclosed are disposed directly in coal which is transferring heat to the domestic water. Using oil as a fuel and placing the auxiliary hot water tanks in the flames of a oil fired boiler would cause many problems, form soot, smoke and in most cases, could not fit into conventional boilers used today. Furthermore, to install domestic water lines through the smoke pipe and have gases pass through a domestic water tank is not practical as it gravitates to the tank and must be heated to move the water. For these reasons, the water heater disclosed in this patent could not be applied to today's conventional oil heating units.

A furnace system for heating air and water is disclosed in U.S. Pat. No. 2,827,893. This system provides a water heater in the exhaust flue in conjunction with a circulation system and a forced air heating system. A summer and winter changeover is used to eliminate the use of the separate water heater in winter and using cold water in the coils in the summer to aid cooling of a building. However, the use of a coil to extract heat from a hot air unit or heat exchanger is very inefficient since the heat is being taken from the home heating air. The use of a separate circulator disclosed in this patent to move water is an additional problem for those who service the unit. Further, the coil is restrictive both to the flow of hot air which is rising and the return air. The patent also discloses the use of a storage tank and expansion tank. However, the use of these is not practical since there are too many parts to be installed. The use of a unit of this type, which is complex, along with a hot water heater is not at all practical as it offers no saving utilizing such a system. The disclosed system merely retards heat flow in the unit and takes heat from it as well.

An energy recovery and storage system is also disclosed in U.S. Pat. No. 4,037,786. This patent teaches an arrangement which provides a heat recovery and storage system utilizing heat transfer pipes and circulating water from a storage tank or heat sink in response to sensors responding to water temperature and flue gas temperature. However, the use of transfer heating rods to heat domestic water is inefficient as the heat only strikes the surface area of those rods. Additionally, the use of a hot water heater and storage tank is costly for the operation of the hot water heater and the extra boost given to it by the energy recovery and storage system is grossly inefficient. The use of a storage tank along with the hot water heater is not practical for the space needed to install such a unit.

In U.S. Pat. No. 3,896,992 there is disclosed a heat recovery system for space heating and for potable water heating. This system provides a heat recovery coil and a flue that may alternately provide additional heat to the heating system or provide preheating of the domestic hot water system. However, the coil inside the flue pipe will restrict flue gas and reduce draft causing soot conditions. Also, dismantling the flue pipe for cleaning can create a substantial problem. Further, the water preheater tank along with the disclosed pressure gauge and pressure relief valve all require additional space. The disclosed system is extremely elaborate, too costly and impractical.

SUMMARY OF THE INVENTION

Among the more important objects of the present invention is to provide an energy recovery system for boiler and domestic water which is compact, simple in construction, economical in cost and highly efficient. By efficiently retrieving heat from the flue gases passing through the stack or exit ducts, cold domestic water is preheated to improve both the efficiency of the boiler as well as increasing the supply of hot domestic water. The increased efficiency results in attendant decreases in the operating costs of the boiler, and the present invention also assures an ample supply of hot domestic water without the need to rely on a separate hot water heater or auxiliary storage or reservoir tanks.

In order to achieve the above objects, as well as others which will become apparent from the description that follows, the energy recovery system for boiler and domestic water in accordance with the present invention cooperates with a heating system having a conventional boiler. The boiler has primary feed and return pipes for feeding the heated boiler water to a heat radiating system and for returning cooled water to the boiler for reheating. A boiler domestic hot water coil is provided having inlet and outlet pipes. A water circulator is provided for circulating boiler water through the boiler and the heating system, and an exhaust duct is arranged to transport the flue gases from the boiler to a chimney stack. The improvement of the present invention comprises a preheater unit arranged in heat exchange relationship with said exhaust duct for extracting heat from said flue gases and recovering the same for heating said preheater unit. Said preheater unit has first flow path means in fluid flow communication with said primary feed and return pipes to cause at least a portion of the water heated in said boiler to flow therethrough and be heated therein. A second flow path means is provided in said preheater unit in fluid flow communication with said boiler domestic hot water coil and the hot and cold domestic water lines of the premises to cause domestic hot water to be preheated in said preheater unit prior to feeding the domestic water to said boiler domestic hot water coil. An electrical control means is provided for controlling the operation of a boiler burner and the water circulator to provide efficient heating of the premises by circulating preheated boiler water through the boiler both during summer and winter months. In the presently preferred mode, the preheater unit is connected to the primary feed and return pipes of the boiler to cause at least some boiler water to circulate through the preheater unit during both winter and summer operations. The domestic water coil within the preheater unit is connected in series flow communication with the boiler domestic hot water coil. A summer/winter switch is added to the boiler electrical circuit to enable the thermostat to regulate the operation of the water circulator during the winter months, while the high limit aquastat regulates the operation of the water circulator and the boiler burner during summer operation.

As will be more fully described below, the preheater unit in accordance with the present invention has no flue pipe restrictions, thus allowing flue gases to pass unrestricted into the chimney. This eliminates the causes of back pressure, as in some of the prior art arrangements discussed before. Further, maintenance of the preheater unit of the present invention is substantially more convenient and at no additional cost. Using boiler water to gravitate through the unit and back to the boiler as suggested in some of the prior art arrangements is outdated. The present invention utilizes the water circulator to move the water through the system and this approach is substantially more efficient. The present invention utilizes the existing water circulator to lower the cost of operation and increase the efficiency of the unit by transferring the heat from the preheater unit to the boiler and back rapidly, thus resulting in improved heat transfer characteristics between the flue gases and the boiler and domestic water.

Further distinguished from the above-described prior art arrangments, in the preheater unit of the present invention, the entire size of the stack pipe is used and heat transfer is directly to the boiler water and the domestic water coil. Thus, the preheater unit does a twofold job of heating the boiler water for more efficient heating of the premises while producing an abundant supply of hot water. Both of these advantageous features result primarily from the extraction of heat from the stack gases, at substantially no additional cost to the user.

As will also become evident, the preheater unit of the present invention does not require any floor space. As noted above, the present invention utilizes the existing circulators to increase heat transfer. In addition to these two advantageous features of the present invention, the cost of installation and operation is substantially reduced as compared with the prior art systems while the efficiency of the system of the present invention is substantially increased.

BRIEF SUMMARY OF THE DRAWINGS

Further advantages of the invention will become apparent from a reading of the following specification describing an illustrative embodiment of the invention. This specification is to be taken with the accompanying drawings in which.

DETAILED DESCRIPTION OF A PREFERRED EMBODIMENT

Figure 1:
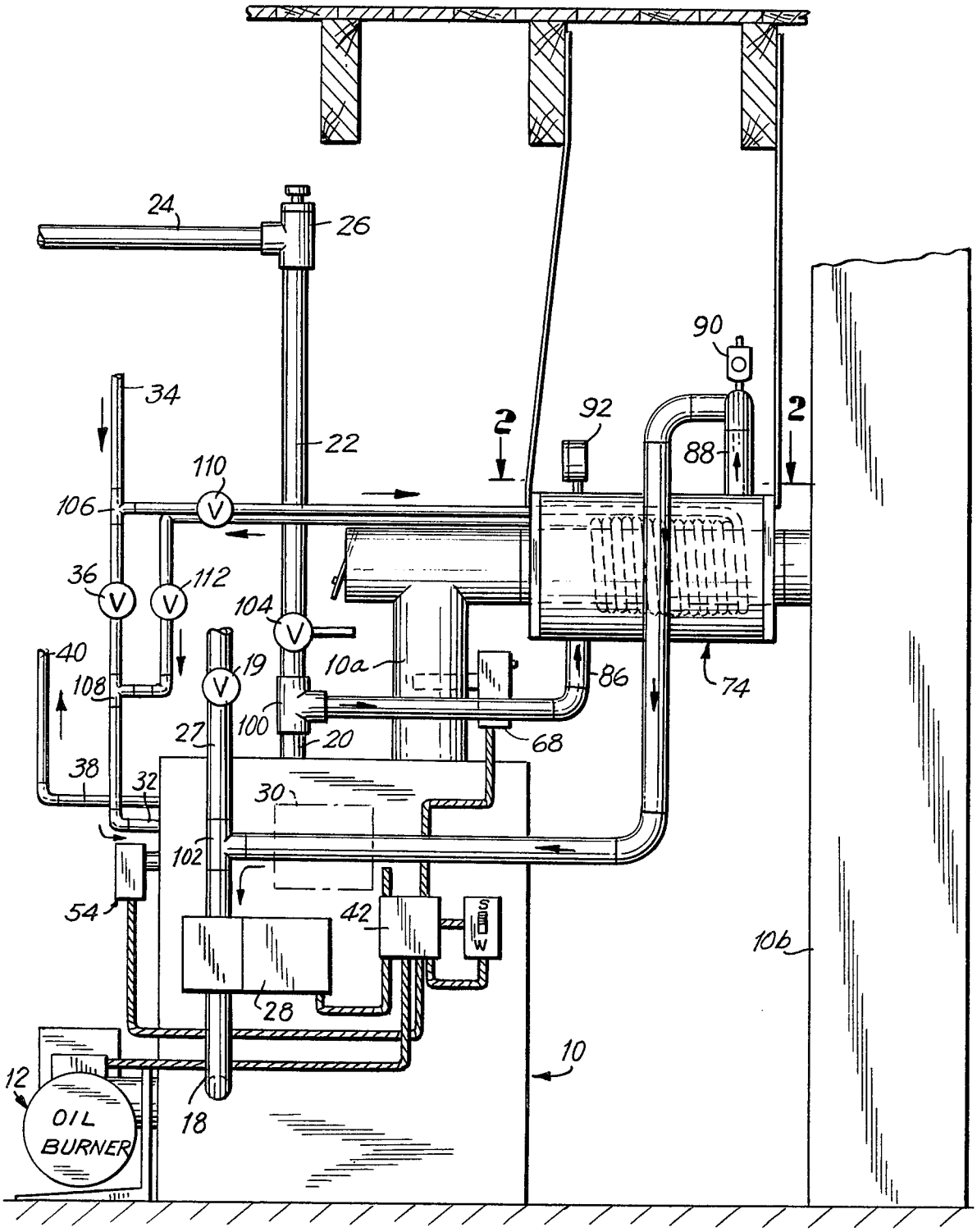
FIG. 1 is a side elevational view of a conventional heating system boiler, and showing the modifications made to the system in accordance with the present invention by adding a preheater tank on the boiler exhaust duct and a summer/winter circulator control switch.

Referring now to the figures, in which identical or similar parts are designated by the same reference numerals throughout, and first referring to FIG. 1, there is shown a conventional boiler designated by the reference numeral 10.

First, the conventional boiler system will be briefly described so that a better understanding may be had of the improvements in accordance with the present invention. In this connection, it is pointed out that while the present invention will be described in connection with one conventional boiler arrangement, it will be evident to those skilled in the art that the elements in accordance with the present invention which have been added to the system to be described can also be added to other heating systems, although slight additional modifications may be appropriate to make the invention compatible with such other systems. Such additional modifications will be evident to those skilled in the art in view of the description that follows.

Figure 3:
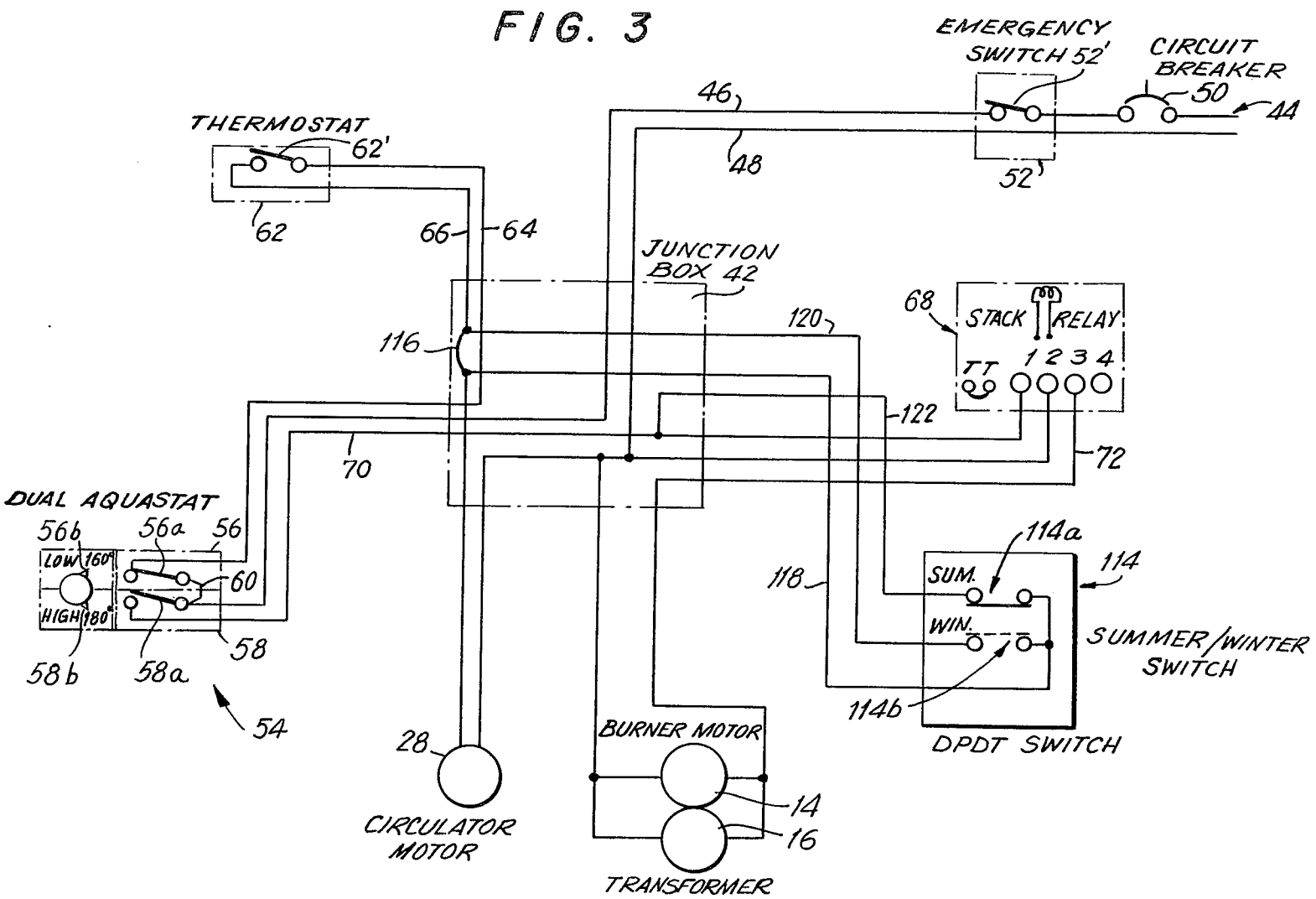
FIG. 3 is an electrical schematic diagram of a conventional boiler electrical system as modified by the present invention primarily by the addition of the summer/winter switch.

The boiler 10 has an oil burner 12 (FIG. 1) which includes a burner motor 14 and an ignition transformer 16 (FIG. 3).

The products of combustion or flue gases are drawn from the boiler 10 through an exhaust duct 10*a* to be discharged into the chimney 10*b* of the premises or dwelling. The exhaust duct 10*a* is normally made from a metallic material, such as tin sheets and, of course, attains very high temperatures when the hot flue gases pass therethrough.

The boiler 10 has a boiler water inlet 18, and a valve 19 is normally in series therewith to permit selective cut off of boiler water return from the radiating system to the boiler.

The boiler 10 has a boiler water outlet 20 which is normally directly connected to the boiler primary feed pipe 22 which feeds the heat radiating pipes 24 through a flow valve 26. After the boiler water flows through the heat radiating system, it returns through a primary return pipe 27 to the inlet 18 through a water circulator 28. The water circulator 28 forces the boiler water through the boiler and through the heat radiating system.

Shown in dashed outline in FIG. 1 is a conventional tankless domestic water heating coil 30 which has an inlet 32 normally directly connected to the cold water supply line 34 by means of a cold water feed valve 36. In the conventional system, the valve 36 is normally open to allow cold water to flow into the coil 30 for heating domestic water.

The coil 30 has an outlet 38 which is normally directly connected to the hot water feed line 40 which feeds the heated domestic water to the household fixtures and appliances.

Referring to FIGS. 1 and 3, the conventional boiler system typically includes a junction or terminal box 42 which interconnects a number of electrical elements or components used for proper operation of the system. In FIG. 3, the reference numeral 44 represents the a.c. power lines which are connected to a source of electrical energy or the power mains. The power lines 44 include a hot or high voltage conductor or lead 46 and a common conductor or lead 48, which may be grounded to the house ground or the system ground. The hot conductor 46 is connected to the power mains through a suitable circuit breaker 50 and an emergency switch 52 which has normally closed contacts 52' during operation of the system.

A dual aquastat is generally designated by the reference numeral 54. While a dual aquastat is shown and will be described, it will become evident from the description that follows that the present invention may also be used in conjunction with a single high limit aquastat.

The dual aquastat 54 is in the nature of a boiler water temperature switch means since it serves to open or close switch contacts at preselected high and low limit boiler water temperatures.

The dual aquastat 54 includes, in effect, two separate aquastats 56 and 58. The aquastat 56 will be described for purposes of the present invention as being the low limit aquastat having a pair of contacts **56*a* which are normally closed within the desired temperature range of the boiler water and which open at a preselected low temperature limit. The aquastat 58 will be referred to as the high limit aquastat and includes contacts 58*a* which open at a preselected high temperature limit for the boiler water and which remain open until the boiler temperature drops below a preselected temperature. The aquastats 56,58 are shown to include respective adjusting means 56*b* and 58*b* which can be used for selecting the low and high temperature limits for the boiler water. These controls are normally independently adjustable. By way of example only, the low limit aquastat 56 may be adjusted to cause the contacts 56*a* to close at 160° F. and remain closed until the boiler water temperature drops to approximately 140° F. The contacts 56*a* will then remain open until the water boiler temperature again increased to approximately 160°. The high limit aquastat 58 may be adjusted so that the contacts 58*a* open at a high temperature of 180° of the boiler water, with such contacts remaining open until the boiler water temperature drops to approximately 160°. The contacts 58*a*** would then remain closed until the water temperature is again elevated to approximately 180°.

One side of each of the switches **56*a* and 58*a* are connected to each other and to the conductor 46 so that a high voltage always appears at the jumped terminals whenever the circuit breaker 50 and the emergency switch 52** are both closed.

In the conventional system, there is provided a thermostat 62 having contacts 62' which open and close depending on the temperature in the premises, closing when the heating requirements are increased and opening when additional heat is unnecessary. One side of the thermostat 62' is connected by means of lead 64 to the contacts **56*a* as shown. The other side of the thermostat switch 62' is normally directly connected to the water circulator 28, one lead of the circulator being grounded or connected to the common lead 48 as shown. With the conventional system, therefore, whenever the boiler water is above a preselected low limit temperature, 140° F. in the example cited, the switch 56*a* is closed, this enabling the thermostat 62 to regulate the operation of the water circulator 28. Whenever the thermostat 62' is closed, the circulator 28 is energized. In this connection, it may be noted that the low limit aquastat 56 is normally used to give domestic water priority of heating. If the low limit aquastat were not used and the switch 56*a*, in effect, was always closed, the circulator 28 would always be energized whenever the thermostat switch 62' was closed. However, this would drive cooled boiler water into the boiler for heating irrespective of the domestic hot water demands. By opening switch 56*a* when the water temperature drops below the low limit, the circulator 28 is deenergized to thereby substantially limit the flow of boiler water through the heating system, and this enabling the boiler to transfer most of the heat to the domestic water coil 30 to thereby more rapidly replenish the domestic hot water supply. Clearly, however, the low limit aquastat is optional if such domestic water priority is desired. However, the use of the low limit aquastat 56** is not a critical feature of the present invention and may be omitted.

A conventional stack relay 68 is shown which monitors the activity of the oil burner. The stack relay has contacts or terminals 1, 2 and 3 connected to the system as shown. Terminals 1 and 2 are the terminals of an internal stack relay coil, and the terminal 2 is connected to the common or ground lead 48. When the high limit aquastat makes or the contacts **58*a* close when the boiler water temperature drops below predetermined value, the hot or high voltage lead 46 is connected to the terminal 1 of the stack relay thereby applying a voltage to the relay coil. Energization of the relay coil causes the high voltage to appear at the terminal 3 of the stack relay which is connected to the high side of the burner motor 14 and the transformer 16. In the conventional system, therefore, when the high limit aquastat makes as a result of dropping boiler water temperatures, the oil burner is fired. Normally, the stack relay 68 includes an internal timing mechanism which monitors the stack temperature so that if within a predetermined period of time the stack temperature does not reach its normal value, the high voltage is removed from the terminal 3 to turn off the oil burner in the event that the oil is not ignited or is otherwise defective. The high limit aquastat 58 is connected to the terminal 1 of the stack relay by means of lead or conductor 70 and the high sides of the burner motor 14 and transformer 16 are connected to the terminal 3 by means of lead or conductor 72, both of which pass through the junction box 42. While a conventional stack relay 68 has been shown, this element is not a critical feature of the present invention and, as noted above, merely serves as a safety feature for the boiler. Additionally, other forms of safety devices may be used in place of the stack relay without adversely affecting the operation of the invention. Thus, instead of a temperature actuated stack relay, other devices may be used which, for example, utilize photosensing techniques to determine whether the burner throws off a flame emitting light to control the continued operation of the boiler. Other devices used in place of the stack relay typically include terminals similar to those described above, and may be readily substituted in place of the described stack relay 68**.

Figure 2:
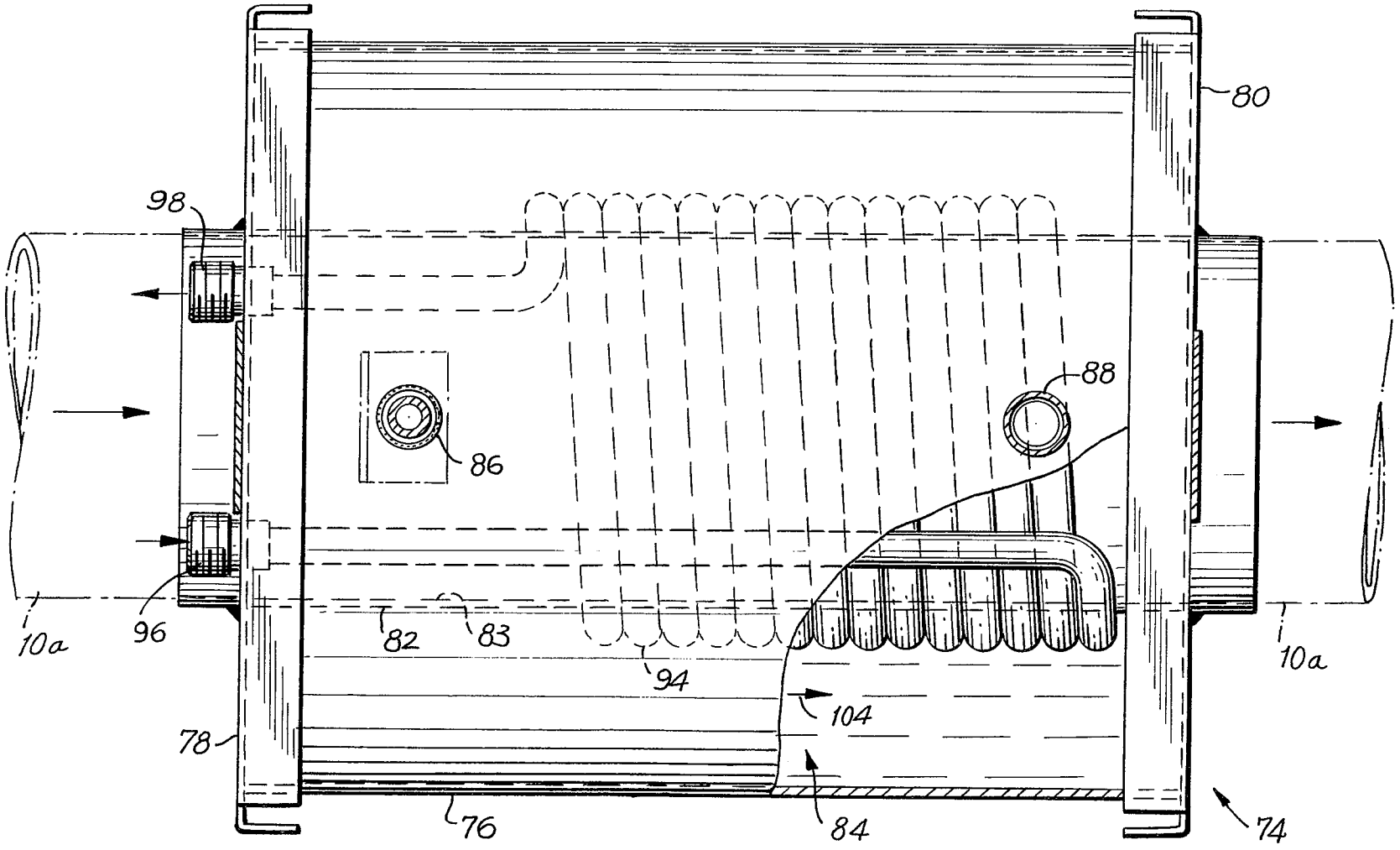
FIG. 2 is an enlarged top plan view of the preheater tank in accordance with the present invention, as viewed in the direction of arrows 2—2 in FIG. 1, and showing a portion of the preheater unit wall broken away to expose an internal domestic hot water tank coil.

An important feature of the present invention is the provision of a preheater unit 74, shown mounted on the exhaust duct 10*a* in FIG. 1 and the details of which are shown in FIG. 2. The preheater unit 74 is arranged in heat exchange relationship with the exhaust duct 10*a* for extracting heat from the flue gases and recovering the same for heating the preheater unit.

It will be readily evident to those skilled in the art that the specific configuration of the preheater unit 74 is not a critical feature of the present invention, and it may take various shapes and forms with differing degrees of advantage. In the embodiment being described, the preheater unit 74 includes a generally circular cylindrical tank side wall 76 and end walls 78 and 80 which are joined to the side wall 76 in any suitable conventional manner to provide a sealed joint therebetween.

The preheater unit 74 also includes an internal wall 82 which is generally parallel to the external side wall 76, the internal wall 82 similarly being joined to the end walls 78 and 80 to form sealed joints therebetween.

The interior wall 82 has an inside surface 83 which defines a generally central passageway for passage of the exhaust flue gases. In the embodiment being described, the exhaust duct is generally circular in cross-section, as is the interior wall 82. For optimum heat transfer characteristics, the passageway advantageously extends generally axially of the preheater tank 74.

The exterior cylindrical wall 76 together with the interior wall 82 and the two end walls 78,80 together define first flow path means in fluid flow communication with the primary feed and return pipes 22, 27 respectively to cause at least a portion of the water heated in the boiler 10 to flow therethrough and be heated therein. The first flow path means, in the embodiment shown, is in the nature of a chamber 84 which has an inlet 86 and outlet 88.

To install the preheater into a new or existing boiler arrangement, there is inserted a T-fitting 100 between the boiler outlet 20 and the primary feed 22 as shown, the T-fitting 100 being connected to the tank inlet 86. Another T-fitting 102 is inserted between the circulator 28 and the primary return pipe 27 as shown, the T-fitting 102 being connected to the outlet 88.

The tank inlet 86 is advantageously positioned on the underside of the preheater unit 74, and downstream of the flow of flue gases. The outlet 88 is advantageously disposed at the top of the tank 74 and upstream of the inlet 86 in relation to the flow of flue gases. With this arrangement, the cooler boiler water enters the inlet 86 and is heated as it progresses in the same direction as the flow of flue gases, this being generally indicated by the arrow 104 in FIG. 2. By the time the boiler water reaches the opposite end of the tank in the region of the outlet 88, the boiler water which flows through the chamber 84 has been heated by the flue gases and, accordingly, tends to rise through the outlet 88, this forcing the boiler water to gravitate through the pipe connecting the preheater tank 74 and the water circulator 28 and the inlet 18 for circulation through the boiler 10. The preheater tank 74 is supplied by the boiler with water which has just been heated therein and which leaves the boiler at the outlet 20.

It will, therefore, become evident that one function of the preheater unit 74 is to heat boiler water, advantageously to a temperature higher than that attainable in the boiler itself, and returning this heated water to the boiler. The introduction of such heated water into the boiler increases the efficiency thereof since it represents boiler water which need not be heated by the boiler itself.

Referring to FIG. 2, the preheater tank 74 is also shown to include a domestic hot water tank coil 94 which is in the nature of a further flow path means which is in fluid flow communication with the boiler domestic hot water coil 30 and the hot and cold domestic water lines of the premises 40,34 respectively to cause domestic cold water to be preheated in the preheater unit 74 prior to feeding the domestic water to the boiler domestic hot water coil 30.

The domestic hot water tank coil 94 is in the nature of a coil pipe disposed interiorly of the chamber 84 in generally close proximity to the central passageway or interior wall 82, and has an inlet 96 connected to the domestic cold water supply line 34 and an outlet connected to the inlet of the boiler domestic hot water coil 30 with the outlet of the latter being connected to the domestic hot water feed line 40.

As described above, the conventional boiler system merely utilizes a valve 36 which is placed in series connection between the inlet of the boiler coil 30 and the cold water supply line 34. This valve 36 is normally open during operation of the boiler to provide a continuous supply of domestic hot water.

To install the preheater unit 74, and particularly the domestic hot water tank coil 94 thereof, there are provided T-fittings 106 and 108 in the cold water supply line 34, one on each side of the cold water feed valve 36 in the manner shown in FIG. 1. The inlet 96 of the coil 94 is connected to the T-fitting 106 through a domestic cold water feed valve 110, while the outlet 98 of the coil 94 is connected to the T-fitting 108 through a domestic hot water return valve 112.

To introduce the domestic hot water tank coil 94 into the boiler system, the valve 36 is closed while the valves 110 and 112 are opened. In effect, the valve 36 and the assocated length of pipe between the T-fittings 106 and 108 are in parallel with the hot water tank coil 94 and the valves 110,112. When the tank coil 94 is to be used, the valve 36 is closed and the valves 110, 112 are opened. To repair the preheater unit 74 or its associated pipes, the valves 110, 112 are closed and the valve 36 is opened to revert to conventional operation without the benefit of using the preheater unit for heating domestic water.

When the cold water enters the tank coil 94 it is heated by both the boiler water which surrounds the coil 94, as well as by the interior wall 82 which is in contact with the flue gases and which transfers the heat to the tank. When the water leaves the coil 94 at the outlet 98 it is normally sufficiently hot for household purposes. However, the heated domestic water is fed to the internal boiler coil 30 where some additional heat may be transferred to the domestic water or the domestic water may transfer some heat to the boiler itself. In those instances where the heated domestic water returns some of the heat to the boiler itself the efficiency of the boiler is thereby enhanced and the overall efficiency for heating the premises in the winter and for heating domestic water is improved.

An advantageous feature of the present invention is that the preheater unit 74 can be used to improve the efficiency of operation of the boiler during both winter and summer operation. In this connection, a valve 104 is advantageously provided which is disposed between the primary feed pipe 22 and the T-fitting 100. During winter operation when hot water must be forced through the primary feed pipe 22 to the radiating system in the premises to be heated, the valve 104 is opened, as is valve 19 on the primary return pipe 27. During summer operation, however, there is no need to force hot water through the household radiating system, and the valve 104 is closed, as is the valve 19 on the return pipe. Although the valves 19, 104 are closed, however, the boiler water circuit is still complete and water may still flow between the boiler and the preheater unit 74 for heating boiler water and domestic water.

Referring to FIGS. 1 and 3, another important feature of the present invention is shown, namely the provision of a selection switch means in the nature of a summer/winter switch 114. The switch 114 has been added primarily to permit selective operation of the water circulator 28 during both winter and summer months.

As noted above, the heated boiler water leaving the outlet 88 of the tank 74 gravitates upwardly and, to that extent, heated boiler water does circulate to a limited extent through the boiler. However, such flow may be slow and may not result in optimum heat transfer characteristics between the flue gases and the boiler water. An air bleed valve 90 may be added to remove additional air in the system. Additionally, a pressure-temperature gauge 92 may be installed as shown in FIG. 1 to display the operating conditions of preheater unit 74. However, the boiler water temperatures can rise rapidly and, for that reason, it is important to maintain a minimum flow rate of boiler water through the tank 74. Using the circulator 28 is advantageous both during the winter and summer months because it cuts down the boiler run time almost in half.

The selection switch 114 is in the nature of a double-pole, double-throw switch having a first set of contacts **114*a*, which are the summer contacts, and contacts 114*b***, which are the winter contacts.

To install the selection switch 114, a wire portion 116 of the lead or conductor 66 is removed so as to break the electrical connection between the thermostat 62 and the water circulator 28. One side of the contacts or switches **114*a*, 114*b* are connected by lead 118 to the circulator 28 where the section 116 has been removed. The other side of the summer switch 114*a* is connected to the high limit aquastat 58 by, for example, being connected to the lead or conductor 70 by means of the lead or conductor 122. The other side of the winter switch 114*b* is connected to the thermostat 62 by means of lead 120 at the point where the wire portion 116** has been removed.

The common or connected terminals of the switches **114*a*, 114*b* are connected by means of the conductor or lead 118 to the circulator 28 as noted before. In the winter months, the selection switch 114 is moved to make or close the switch 114*b* to thereby connect the thermostat 62 with the circulator 28 in the same way as prior to the removal of the section 116. Thus, for winter operation, the thermostat 62 energizes the water circulator 28 when the selection switch is in the winter position and the low limit aquastat switch 56*a* is closed at elevated boiler water temperatures. Whenever the premises require additional heat, the thermostat switch 62' closes to energize the circulator 28. The selection switch 114, therefore, merely replaces the jumper lead 116** which is removed on installation of the switch and the circulator is actuated in the same manner as before the incorporation of the elements in accordance with the present invention.

During the summer months, however, the thermostat switch 62' is normally maintained open since no heating of the premises is required. As noted above, however, it is desirable to energize the circulator 28 when heating water within the preheater unit 74. By connecting the summer switch **114*a* between the circulator 28 and the high limit aquastat 58 as shown, the circulator is caused to be energized whenever the boiler water cools down sufficiently and the oil burner is actuated. By closing the summer switch 114*a*, the circulator 28 is attached to the high limit aquastat and remains deenergized as long as the boiler water is within its differential setting. In the example mentioned, when the boiler temperature drops, for example, below 160° F., the switch 58*a* closes, this applying the power line voltage to the circulator 28 through the summer switch 114*a*, as well as energizing the stack relay 68 and, through the relay, energizing the burner motor 14 and the transformer 16. With this arrangement, therefore, during the summer setting of the selection switch 114, the circulator 28 is initiated whenever the oil burner is activated to insure that whenever flue gases raise the temperature of the preheater unit 74 that the boiler water flowing through the chamber 84** is moved at an adequate rate.

During the winter months, when the switch **114*b* is closed, the thermostat 62 controls the operation of the circulator, as noted above. However, because the thermostat switch 62' makes periodically, the boiler water is sufficiently circulated through the preheater unit even though there may be moments when the circulator 28 is not energized while the oil burner 12 is on. As suggested above, it is not essential that a dual aquastat 54 be used as shown, and the present invention may be incorporated in a system using only the high temperature unit 58. In that case, one side of the thermostat switch 62' is always connected to the high voltage or hot lead 46 and the circulator is controlled, in the winter months, by the thermostat 62** independently of the boiler water temperature. In the summer months, however, the operation of the single aquastat arrangement would be substantially as described above.

It is to be understood that the foregoing description of a presently preferred embodiment illustrated herein is exemplary and various modifications to the embodiment shown herein may be made without departing from the spirit and scope of the invention.

What is claimed:

1. In a heating system having a boiler; a primary feed pipe for feeding heated water from the boiler to a heat radiating system of a premises, a primary return pipe for returning cooled water to the boiler for reheating; a boiler domestic hot water coil having inlet and outlet pipes, a water circulator for circulating boiler water through the boiler and the heating system, and an exhaust duct for transporting the flue gases from the boiler to a chimney stack, the improvement comprising a preheater unit arranged in heat exchange relationship with said exhaust duct for extracting heat from said flue gases and recovering the same for heating said preheater unit, said preheater unit having first flow path means in fluid flow communication with said primary feed and return pipes to cause at least a portion of the water heated in said boiler to flow therethrough and be heated therein; and a second flow path means in fluid flow communication with said boiler domestic hot water coil and the hot and cold domestic water lines of the premises to cause domestic cold water to be preheated in said preheater unit prior to feeding the domestic water to said boiler domestic hot water coil; and electrical control means which can be set for winter and summer operations for controlling the operation of a boiler burner and the water circulator to provide efficient heating of the premises, comprising a source of electrical energy, a thermostat, boiler water temperature means, and selection switch means interconnected with each other and with said water circulator, said thermostat being arranged to energize said water circulator when said selection switch means is set for winter operation, said boiler water temperature switch means energizing said water circulator when the boiler water temperature drops below a predetermined temperature and said selection switch means is set for summer operation.

2. In a heating system as defined in claim 1, wherein said preheater unit is in the nature of a tank having an interior wall defining a generally central passageway for passage of the flue gases in communication with said exhaust duct.

3. In a heating system as defined in claim 2, wherein said tank is generally cylindrical and said passageway extends generally axially thereof.

4. In a heating system as defined in claim 2, wherein said tank has an exterior wall which together with said surface of said passageway form a chamber which defines said first fluid flow means and has an inlet corrected to primary return pipe and an outlet connected to said primary return pipe.

5. In a heating system as defined in claim 4, wherein said second flow path means comprises a coil pipe disposed interiorly of said chamber in generally close proximity to said central passageway, and having an inlet connected to the domestic cold water supply line and an outlet connected to said inlet of said boiler domestic hot water coil with the outlet of the latter being connected to the domestic hot water feed line.

6. In a heating system as defined in claim 1, wherein said first flow path means has an inlet pipe connected to said primary feed pipe at a predetermined point thereof; and further comprising valve means between said predetermined point and said heat radiating system for selectively premitting and inhibiting boiler water from flowing from said boiler to said heat radiating system without inhibiting the flow of boiler water to said first flow path means in said preheater unit.

7. In a heating system as defined in claim 1, wherein said water circulater is disposed in said primary return pipe proximate to said boiler and wherein said first flow path means has an outlet pipe connected to said primary return pipe at a point thereof between said water circulator and said heat radiating system, whereby said water circulator circulates water through said first flow path means in said preheater unit independently of any flow of boiler water through said heat radiating system.

8. In a heating system as defined in claim 1, wherein said boiler water temperature switch means comprises a normally open switch which closes only when the boiler water temperature drops below said predetermined temperature, said normally open switch being in electrical series connection with said source of electrical energy and said water circulator when said selection switch means is set for summer operation, whereby said water circulator is energized in the summer when the boiler water temperature drops below said predetermined temperature independently of the state of said thermostat.

9. In a heating system as defined in claim 1, wherein said selection switch means comprises a double-pole, double-throw switch, one of the poles closed for winter operation being in series connection between said thermostat and said water regulator, and the other of the poles closed for summer operation being in circuit connection with said boiler water temperature means.

10. In a heating system as defined in claim 1, wherein said boiler has a burner motor and a transformer, and further comprising a stack relay connected to said boiler water temperature means and to said burner motor and transformer for energizing the same when the boiler water temperature drops below said predetermined temperature.

11. In a heating system as defined in claim 1, wherein said electrical control means can be set for winter and summer operation and comprises a source of electrical energy, a thermostat, first and second boiler water temperature means, and selection switch means interconnected with each other and with said water circulator, said first boiler water temperature switch means enabling said thermostat to energize said water circulator when said selection switch means is set for winter operation and the boiler water temperature is above a first predetermined temperature, and said second boiler water temperature switch means energizing said water circulator when the boiler water temperature drops below a second predetermined temperature and said selection switch means is set for summer operation.

12. In a heating system as defined in claim 11, wherein said first boiler water temperature switch means comprises a normally closed siwtch which opens only when the boiler water temperature drops below said first predetermined temperature, said normally closed switch being in electrical series connection with said thermostat, source of electrical energy and water circulator when said selection switch means is set for winter operation, whereby said thermostat energizes said water circulator in the winter when the boiler water temperature is above said first predetermined temperature.

13. In a heating system as defined in claim 11, wherein said selection switch means comprises a double pole, double throw switch, one of the poles closed for winter operation being in circuit connection with said first boiler water temperature means, and the pole closed for summer operation being in circuit connection with said second boiler water temperature means.

* * * * *